US005165538A

United States Patent [19]

Peters

[11] Patent Number: 5,165,538

[45] Date of Patent: Nov. 24, 1992

[54] BASEBALL HOLDER FOR DISPLAY PURPOSES

[75] Inventor: W. H. Peters, West Unity, Ohio

[73] Assignee: Baseball Card World, Inc., Anderson, Ind.

[21] Appl. No.: 627,227

[22] Filed: Dec. 14, 1990

[51] Int. Cl.[5] ..... B65D 85/00; G09B 25/00; G09F 3/18; A47F 7/00

[52] U.S. Cl. ..... 206/315.9; 40/661; 434/392; 211/14

[58] Field of Search ..... 206/315.9; 211/14; 434/392, 365, 393; 40/661, 323, 642

[56] References Cited

U.S. PATENT DOCUMENTS

| | | | |
|---|---|---|---|
| 54,367 | 10/1820 | Bierbach | 211/14 |
| 521,613 | 6/1894 | Hiller | 211/14 |
| 1,645,399 | 10/1927 | Pontikis | 211/14 |
| 1,861,948 | 6/1932 | Barkdoll | 206/315.9 |
| 1,921,015 | 8/1933 | Young | 206/315.9 |
| 4,955,485 | 9/1990 | Alton | 211/14 |

FOREIGN PATENT DOCUMENTS

| | | | |
|---|---|---|---|
| 565465 | 7/1960 | Belgium | 40/642 |

*Primary Examiner*—Paul T. Sewell
*Assistant Examiner*—M. Denise Patterson
*Attorney, Agent, or Firm*—George R. Royer

[57] ABSTRACT

The subject apparatus is a ball holder adapted and constructed for display purposes, as used to hold within the confines of the holder a baseball, or other type of ball, to be displayed inside a transparent cover, so as to be viewable from the outside, with the device comprising a base member adapted to rest on a horizontal surface with the upper part of the base member having integrally affixed thereto a transparent globular hollow member in which a ball is inserted for storage and viewing purposes. The base has further means adapted to connect the base, in a fixed manner, to the surface upon which it is adapted to rest.

3 Claims, 1 Drawing Sheet

BASEBALL HOLDER FOR DISPLAY PURPOSES

DISCUSSION OF PRIOR ART AND BACKGROUND OF INVENTION

The invention herein relates to devices used to hold balls, such as souvenir balls for display purposes. In this regard, it is not uncommon for sports fans, athletes, and others to display souvenir balls, such as autographed baseballs, and other such balls. Usually, such balls are displayed at a vantage point in a home or office, such as on a mantle piece, desk, table, or dresser, or other item of furniture.

For the purposes of such display, various holder devices have been conceived in order to facilitate the display of the ball, or other sports paraphernalia. One such device, as particularly adapted for baseball displays, comprises a clear plastic member formed as a hollow spherical member, with such hollow spherical member being formed by two opposing semispherical members that can be joined together along joining circumferential edges. The ball, which is to be displayed, is adapted to be held and is placed within the sphere, as the sphere rests on the cylindrical base. While this type of display holder provides a display apparatus, there are several deficiencies in this type of holder and one such shortcoming is that the base member in such device has no suitable means to affix the base to the surface on which it is adapted to rest. Other shortcomings in the prior art devices are prevalent and the subject apparatus is adapted and conceived to overcome these problems with prior art devices, and the following objects of the subject invention are directed accordingly.

OBJECTS

The following are objects of the subject invention:

It is an object of the subject invention to provide an improved holder for souvenir balls;

Another object of the subject invention is to provide an improved ball holding device;

Yet another object of the subject invention is to provide an improved device for displaying athletic paraphernalia.

Still another object of the subject invention is to provide a device for holding baseballs for display purposes;

A further object of the subject invention is to provide an improved display device;

Other and further objects of the subject invention will become apparent from a reading of the following description taken in conjunction with the claims.

DESCRIPTION OF GENERAL EMBODIMENT

Figure 1:
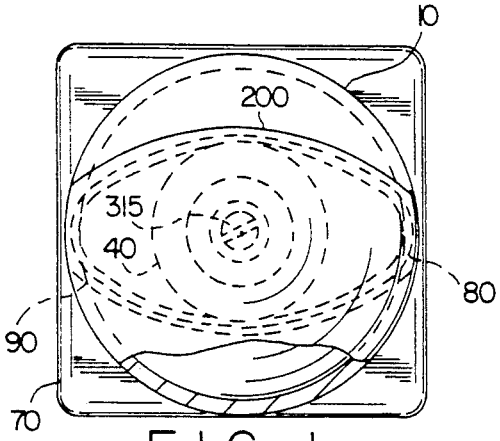
FIG. 1 is a perspective view of the subject device, shown partially in sectional view.
Figure 4:
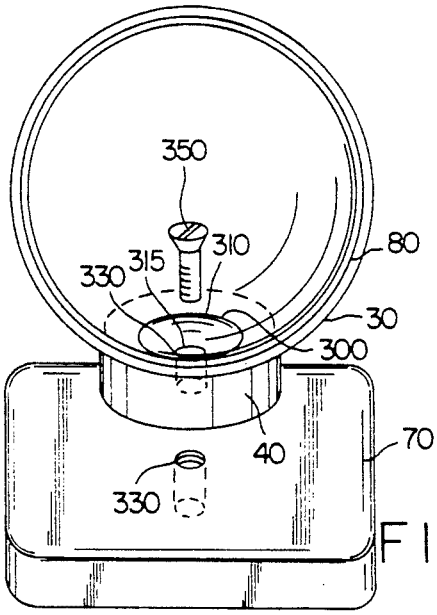
FIG. 4 is a perspective view of the subject apparatus.

The subject apparatus is a ball holder adapted and constructed for display purposes, as used to hold within the confines of the holder a baseball or other type of ball, to be displayed inside a transparent cover, so as to be viewable from the outside, with the device comprising a base member adapted to rest on a level surface with the upper part of the base member having integrally affixed thereto a transparent globular hollow member in which a ball is inserted for storage and viewing purposes. The base has further means adapted to connect the base, in a fixed manner, to the surface upon which it is adapted to rest.

DESCRIPTION OF PREFERRED EMBODIMENT

In describing the preferred embodiment of the subject invention, it is to be stressed that the following description is only one embodiment of several incorporating features of the subject invention, and thus by such description shall not be considered as limiting the scope of the subject claims.

Referring now to the drawings in which a preferred embodiment of the subject invention is shown, a ball holder 10 is shown. The baseball holder 10 is shown as being adapted to hold baseballs, although the holder can be manufactured and adapted as to size and shape to accommodate various types of sporting balls, regardless of size.

The baseball holder 10 is comprised of two portions, preferably of transparent composition, that are readily separable from one another. Specifically, there is an upper semispherical portion 20 and a lower semispherical portion 30. The lower semispherical portion 30 is a semispherical member, having an upper portion and a lower portion. The lower surface part of the lower portion semispherical 30 is affixed to a hollow cylindrical base member 40 that is the base upon which the holder 10 is adapted to rest. More specifically, the base 40 is affixed to the lower surface part or bottom extremity of the lower semispherical portion 30 of the holder 10, as seen in the drawings. Further, as can be seen, the cylindrical base 40 has an upper circumferential rim 50 and a lower circumferential rim 60. The base 40 is adapted to rest on any surface by the lower circumferential rim 60 being adapted to be flush against the surface 70 on which the holder 10 is adapted to rest. The upper circumferential rim 50 is seated and affixed tangentially against the adjoining spherical surface portions of the lower part 45 of the lower semispherical portion 30 of the holder 10. The base 40 and the lower semispherical portion 30 form the overall base portion of the holder 10. However, it is to be noted that the lower portion 30, as well as the upper portion 20 need not be formed exactly as a semispherical member so long as such lower portion and such upper portion join together and form a spherical member.

Figure 3:
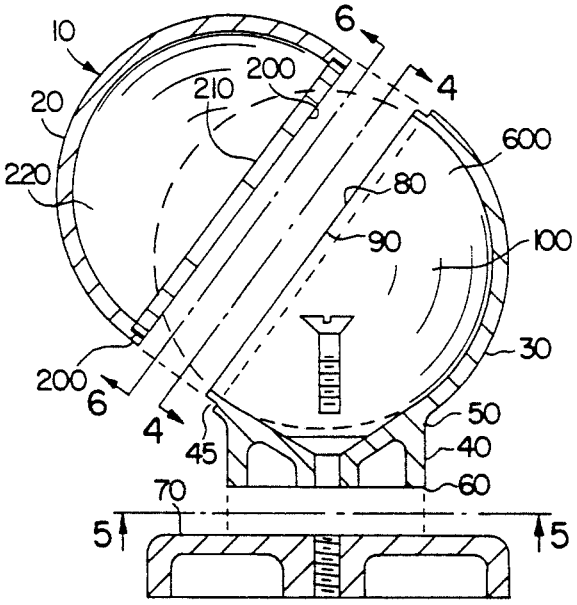
FIG. 3 is a side elevational view showing the positioning and method of joinder of the two semispherical portions of the holder.
Figure 6:
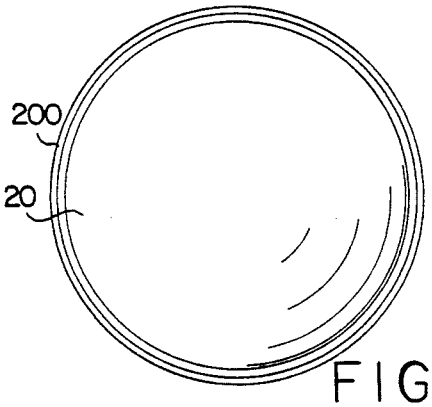
FIG. 6 is a top elevational view of the bottom semispherical portion of the subject apparatus.
Figure 5:
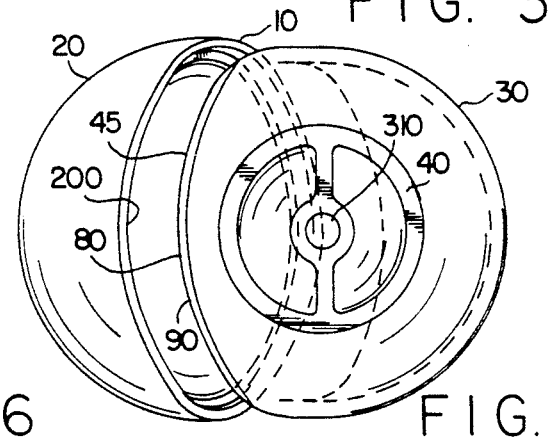
FIG. 5 is a top elevational view of the subject apparatus.

The upper part 100 of the lower semispherical portion 30 is formed as a partially spherical indentation that extends downwardly into the upper part of the lower semispherical portion 30 of the holder 10, as shown. Thus, more specifically, the upper part 100 of the lower semispherical portion, as viewed downwardly from an upper elevational view, as seen in FIG. 3, has a circular opening 80 at the top or upper part of such semispherical lower power 30, such opening 80 being formed by a circular rim 90 that forms the upper and outer perimeter or circumference of the opening. Such opening 80 is thus exposed to space outside the holder 10, as seen whenever upper semispherical portion is not fastened on the lower semispherical portion.

Figure 2:
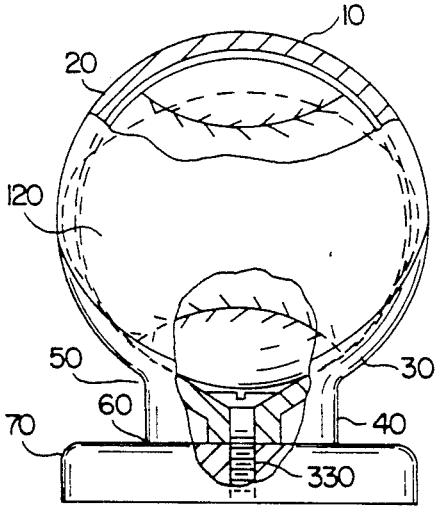
FIG. 2 is a side view of the subject apparatus shown in a mounted display position.

In the subject invention and apparatus, the rim 90 that forms the outer perimeter circumference of the opening 80 on the lower semispherical portion 30 can be level or parallel with the upper rim 50 of the cylindrical base 40 on the lower portion of the holder 10. In the preferred embodiment of the subject invention, the circumferential rim 90 is formed at an angle and offset from a horizontal plane, such horizontal plane defined by the base surface 70 on which the holder 10 rests. More particularly, the circular rim 90 is formed on the upper part 100 of the lower semispherical portion 30 such that the circular rim 90 and thus the opening 80 is cut an angle slope so that one portion of the opening 80 is lower than the opposing portions of the opening 80, as viewed from a side view, and as more specifically seen in FIG. 3. The upper portion 20 of the holder 10 is a semispherical member with a circular opening 200 defined by a circular rim 210 forming an interior cylindrical space 220. The upper portion 20 of the holder 10 is then placed conformingly over the upper exposed portion of the ball 120, as seen in FIGS. 2 and 3, with the bottom rim 210, and thus cylindrical space 220 being placed conformingly over the top surface of the ball 120 such that the rim 210 is fitted conformingly into mating rim 90 of the lower semispherical portion 30, as seen in the drawings. Thus placed together, the ball 120 is stored inside the hollow spaces of the upper semispherical portion 20 and the lower semispherical portion 30.

As can be seen from the drawings, the bottom inner surface of the hollow space 100 has formed therein an oblong depression 300, such depression having an upper perimeter 310 that is contiguous with the lower surface of the inner space 100. The depression 300 slopes downwardly into a countersunk cylindrical opening 330 that extends vertically downwardly and completely through the bottom of the base 40. By this latter arrangement, a nail or screw 350 can be inserted through opening 315 to affix the holder to a wooden or other surface, as seen.

I claim:

1. A holder for a ball adapted to rest on a base surface comprising:

(a) a lower base member, said base member adapted to rest flush on the base surface having an open first spherical indentation in the upper part thereof with said spherical indentation forming a first circular rim at the part wherein such second spherical indentation is open with said base member having an opening in the bottom of the indentation thereof, such opening being form on its upper part as an oblong depression extending to a lower cylindrical part that extends completely downwardly through said base member so as to receive a fastening member through such opening to extend to the base surface, said first circular rim member being disposed at an angle and other than parallel to the base surface;

(b) an upper portion having an open second spherical indentation in the lower part thereof, with said spherical indentation forming a second circular rim at the part of the said upper portion where it is open, said second circular rim being adapted to fit conformingly over said first circular rim, said second circular rim being disposed at an angle that is the same angle as the first circular rim member specifically other than parallel to the base surface relative to the base surface.

2. A holder for a ball of hollow spherical shape for resting on a base surface comprising:

(a) a lower portion, having bottom surface, said lower portion having a semispherical member, an inner hollow cavity and an upper circular rim on its upper part and which semispherical member has an opening on the upper rim part of said lower portion, upper circular rim, which opening communicates directly with the inner hollow cavity in said lower portion and wherein the circumference of said upper circular rim opening is disposed other than parallel to said bottom surface of said lower portion and wherein said lower portion has an opening for receiving fastening member extending downwardly completely from the interior of said inner cavity of said lower portion to the bottom surface, with said opening having a countersunk portion of oblong shape in the upper part thereof.

(b) an upper semispherical portion, said upper semispherical portion having on its lower part an internal cavity of semispherical shape and which upper semispherical portion has a lower circular rim opening on the lower part thereof, said lower circular rim opening being adapted to fit conformingly over the upper circular rim of the lower semispherical member, and wherein said lower circular rim opening as positioned over the upper circular opening in the lower portion is disposed at an angle other than parallel to the bottom surface, and wherein such angle is the same angle as the angle of disposition of the upper circular opening relative to the bottom surface on said lower portion, which angle is other than parallel to the base surface.

3. A holder for a ball comprising:

(a) a base member, said base member having an upper surface and a lower surface, which said lower surface is flat and adapted to rest on a separate surface, said base member having a longitudinally extending opening extending vertically downwardly from the upper surface to the lower surface, said opening adapted to hold a fastening member to be affixed through the separate surface;

(b) a lower transparent portion having an upper part and a lower part, said lower transparent portion having a partially open spherical indentation on its upper part, which open spherical indentation has a circular rim on its upper part that forms an opening between the open spherical indentation and the spatial areas outside thereof, and wherein said lower transparent portion is affixed on its lower part to the upper surface of said base member, and wherein said lower transparent portion has an oblong countersunk opening at the lowermost part of the spherical indentation of the lower transparent portion, which countersunk opening communicates with said opening in the base member so as to form a continuous passage to receive a fastening member through the countersunk opening in the lower transparent portion and said opening in the base member, and wherein said circular rim member on said lower transparent portion is disposed at an angle, relative to the lower surface of said base member other than at a parallel relationship;

(c) an upper transparent portion having an open partial spherical indentation and a circular rim portion that forms the opening between the partial spherical indentation and the spatial areas outside thereof, and wherein the circular rim portion on said upper transparent portion is disposed at an angle relative to the lower surface of said base member and which angle of the circular rim on the upper transparent portion is disposed at the same relative angle to the lower surface of said base member as the angle of disposition of the circular rim on the lower transparent portion relative to the lower surface of said base member, and wherein said circular rim member on the upper transparent portion is adapted to fit conformingly over the rim on the lower transparent portion, whereby the upper transparent portion and the lower transparent portion are joined as a unitary hollow spherical member at their respective circular rim members.

* * * * *